US007958967B2

(12) United States Patent
Lambdin

(10) Patent No.: US 7,958,967 B2
(45) Date of Patent: Jun. 14, 2011

(54) MUD SILL

(76) Inventor: James Lambdin, Channahon, IL (US)

( * ) Notice: Subject to any disclaimer, the term of this patent is extended or adjusted under 35 U.S.C. 154(b) by 1181 days.

(21) Appl. No.: 11/653,117

(22) Filed: Jan. 12, 2007

(65) Prior Publication Data

US 2008/0168740 A1 Jul. 17, 2008

(51) Int. Cl.
*E04G 1/00* (2006.01)

(52) U.S. Cl. ..... 182/179.1; 248/240.2

(58) Field of Classification Search ..... 52/111, 52/637, 651.1; 248/240.2; 182/179.1
See application file for complete search history.

(56) References Cited

U.S. PATENT DOCUMENTS

| | | | | | |
|---|---|---|---|---|---|
| 483,841 | A | * | 10/1892 | goodnow | 248/501 |
| 1,554,327 | A | * | 9/1925 | Boberg | 248/346.11 |
| 2,185,948 | A | | 1/1940 | Pimm | |
| 2,284,847 | A | * | 6/1942 | Raymond | 403/350 |
| 2,534,682 | A | | 12/1950 | Robishaw | |
| 2,584,015 | A | | 1/1952 | Hawes | |
| 3,011,749 | A | * | 12/1961 | Kozak | 410/81 |
| 3,190,405 | A | | 6/1965 | Squire | |
| 3,233,319 | A | * | 2/1966 | Jensen et al. | 29/437 |
| 3,257,765 | A | | 6/1966 | Anderson et al. | |
| 3,331,333 | A | * | 7/1967 | Coulson | 410/81 |
| 3,442,480 | A | * | 5/1969 | Marvin et al. | 410/76 |
| 3,470,663 | A | | 10/1969 | Tate | |
| 3,656,269 | A | | 4/1972 | Witschel et al. | |
| 3,860,209 | A | * | 1/1975 | Strecker | 410/116 |
| 4,048,776 | A | * | 9/1977 | Sato | 52/297 |
| 4,078,633 | A | | 3/1978 | Fahy | |
| 4,216,933 | A | | 8/1980 | Cramer | |
| 4,245,438 | A | * | 1/1981 | van Buren, Jr. | 451/509 |
| 4,254,927 | A | * | 3/1981 | Stonhaus | 248/346.5 |
| 4,283,899 | A | * | 8/1981 | Wakamiya | 52/699 |
| 4,346,540 | A | * | 8/1982 | Anderson | 52/274 |
| 4,400,856 | A | * | 8/1983 | Tseng | 24/590.1 |
| 4,457,650 | A | * | 7/1984 | Tseng | 410/111 |
| 4,527,760 | A | * | 7/1985 | Salacuse | 248/108 |
| D284,164 | S | * | 6/1986 | Tseng | D8/382 |
| 4,599,768 | A | * | 7/1986 | Doyle et al. | 24/594.11 |
| 4,645,392 | A | * | 2/1987 | Takaguchi | 410/80 |
| 4,698,875 | A | * | 10/1987 | Kreeger | 16/30 |
| 4,708,531 | A | * | 11/1987 | Plenter | 405/296 |
| 4,817,402 | A | * | 4/1989 | Leiding | 70/58 |
| 4,919,230 | A | | 4/1990 | Langer et al. | |
| 4,958,875 | A | * | 9/1990 | Zamzow | 296/32 |
| 5,035,398 | A | * | 7/1991 | Chiang | 248/674 |
| 5,199,916 | A | * | 4/1993 | Prickett | 441/75 |
| 5,290,195 | A | * | 3/1994 | Prickett | 441/75 |
| 5,297,407 | A | * | 3/1994 | Tarr | 70/232 |

(Continued)

*Primary Examiner* — Alvin C Chin-Shue
*Assistant Examiner* — Candace L Bradford
(74) *Attorney, Agent, or Firm* — Wood, Phillips, Katz, Clark & Mortimer

(57) ABSTRACT

The combination of: a scaffold assembly comprising a vertical member; a baseplate on the vertical member and having a downwardly facing surface; and a foot having a top surface and a bottom surface spaced in an axial direction. The foot has an opening in the top surface and a recess extending axially from the opening toward the bottom surface. The recess accepts the baseplate with the baseplate in an operative position. The downwardly facing surface bears on the foot so as to cause a downward force produced by the vertical member to be applied to the foot and distributed by the foot through the bottom surface to an underlying support surface for the scaffold assembly. The bottom surface on the foot has a peripheral edge that bounds an area that is greater than an area bounded by a peripheral edge of the baseplate.

11 Claims, 4 Drawing Sheets

U.S. PATENT DOCUMENTS 5,395,086 A * 3/1995 Goldstein ..... 248/346.5
5,507,199 A * 4/1996 Lampani ..... 74/473.3
5,526,598 A * 6/1996 Watanabe ..... 40/308
5,607,251 A * 3/1997 Rafn ..... 403/348
5,626,435 A * 5/1997 Wohlhuter ..... 403/348
D386,140 S * 11/1997 Pingel et al. ..... D12/217
D386,141 S * 11/1997 Pingel et al. ..... D12/217
5,685,642 A * 11/1997 Gaskell ..... 374/206
5,913,605 A * 6/1999 Jusselin et al. ..... 37/451
5,920,969 A * 7/1999 Vuorinen ..... 24/614
6,092,342 A 7/2000 Sharapata
6,135,687 A * 10/2000 Leek et al. ..... 411/10
6,276,879 B1 * 8/2001 Hecht ..... 409/234
6,318,947 B1 * 11/2001 Hahn et al. ..... 414/401
6,336,620 B1 1/2002 Belli
6,382,488 B1 * 5/2002 Hancock ..... 224/547
6,422,795 B2 * 7/2002 Holt et al. ..... 410/115
6,490,766 B1 * 12/2002 Tiemann ..... 24/287
6,606,823 B1 * 8/2003 McDonough et al. ..... 47/65.9
6,666,635 B2 * 12/2003 Holt et al. ..... 410/115
6,669,163 B2 12/2003 Davis, Jr.
6,874,745 B1 * 4/2005 Bean ..... 248/346.01
6,929,223 B2 * 8/2005 Hancock et al. ..... 248/74.2
6,988,700 B2 1/2006 Cote
7,025,385 B2 * 4/2006 Drescher ..... 285/91
7,032,712 B2 4/2006 Schworer
7,066,366 B2 * 6/2006 Hancock et al. ..... 224/401
7,100,808 B2 * 9/2006 Hancock et al. ..... 224/547
2006/0060422 A1 * 3/2006 VanDerHyden ..... 182/82
2007/0006691 A1 * 1/2007 Leek et al. ..... 81/176.1

* cited by examiner 22
28
26a
26
20

7
4
4a
8
3a
5
1a
4a
4
3
7a
1
3a
1b
2

7a
1a
1
2
1b

MUD SILL

BACKGROUND OF THE INVENTION

The present invention relates to a support structure of scaffold pipe, framework construction, and more particularly the invention relates to an improved mud sill that attaches to a base foot plate of a scaffold like framework. The scaffold assembly is constructed from tubular alignments having plural, singular, and vertically arranged rigid horizontal frames. A frame is typically a rectangular construct but can also be triangular in configuration. The other ends of the upright corner post elements of such vertical frames interconnect at two corners. The mud sill is the lowest element for a scaffolding foundation which rests between the lower steel baseplate of screw jack and the ground upon which the scaffolding stands. In order to distribute vertical load on the ground that may shift, the baseplate is typically nailed to a mud sill. The mud sill may be an elongated eight by ten which is disposed under and fastened to a number of parallel baseplates with nails or it can consist of sections of shorter two by ten lumber that is attached to an individual baseplate.

General requirements of OSHA regulations (Section 1926.451c) in connection with the criteria for supporting scaffold provides that the supported scaffold poles, posts, frames, and uprights shall bear on baseplates and sills or other adequate firm foundation.

Scaffolding to support workers above the ground during construction is well-known in the art and many variations have been considered. One very common type of scaffolding used during construction of a wall or other structure includes a set of four uprights, bridged by sets of horizontal support members. Cross-braces extend between pairs of uprights to stabilize the scaffolding. The horizontal support members provide a frame across which a set of planks, typically made of wood, are laid to form a platform upon which workers can stand. As progress is made during construction, the horizontal support members are raised and locked in place at new heights, allowing workers standing atop thereof to work on higher sections of the wall being constructed. Additional uprights can be affixed atop the scaffolding, thus allowing higher levels of horizontal support members and platforms to be put in place.

Scaffolding of this nature is generally ground-based: supported on the ground surface. When supported on the ground surface, the uprights are typically placed atop swivel base screw jacks for leveling the scaffolding. The base of each screw jack typically has a flat baseplate that is nailed to a wood block or an elongated board, i.e. mud sills, that are placed on the ground. The mud sills distribute the weight of the scaffolding over a larger area of the ground than provided by the baseplate ends of the uprights to inhibit the uprights from sinking into the ground.

Although the above-described scaffolding is common, it is time consuming to erect. Also, during construction of such scaffolding, care must be taken to ensure that the uprights firmly rest on the ground and, thereafter, that each horizontal support member is level. As the scaffolding is generally free-standing, it is also important to ensure that the scaffolding is stable. As will be appreciated, slight shifting in the ground can result in unstable scaffolding or, even worse, its collapse. Of particular concern is the time and effort required to attach mud sills to the scaffolding which typically requires that the baseplate be nailed to the wood block or board. Fastening is often done using a minimum number of nails when a maximum of four nails could be used. Additionally, nails are often hammered in only part of the length of the nail and then bent over, leaving the fastening weaker than it would be if the nails were fully inserted by hammering. Another disadvantage to the use of current mud sills is when the scaffolding is taken down or reconfigured, the mud sills are generally removed from the baseplate, which means that additional labor is required to extract the nails and then the nails, discarded as bent nails, are seldom reused.

ADVANTAGES OF THIS INVENTION

To alleviate this problem, and others which will become apparent from the disclosure which follows, the present invention conveniently teaches an improved mud sill that is easy to install and remove with a minimal amount of labor required. The improved mud sill attaches securely to the baseplate of a screw jack or scaffolding assembly without the use of extraneous fasteners, such as nails or screws. The improved mud sill is generally disk shaped with a top surface and a bottom surface and an axis extending between the top surface and the bottom surface. A multi-layered recess is provided in the improved mud sill to receive a baseplate axially and then the improved mud sill is rotated relative to the baseplate to secure it in place. Once installed the improved mud sill of this important invention is restricted three dimensionally to the baseplate and yet it can easily be removed by a counter-rotation from the installation process. Time and labor costs are substantially reduced.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Still other advantages will be apparent from the disclosure that follows.

SUMMARY OF THE INVENTION

According to one aspect of the invention, an improved mud sill, for use with a generally horizontal baseplate of a base of a vertical scaffolding member, is taught comprising a foot with a transverse dimension measured in all directions that is substantially greater than each dimension in a parallel direction of the generally horizontal baseplate, and with a top surface that has an opening, a bottom surface, and an axial dimension, measured between the top surface and the bottom surface, that is perpendicular to the transverse dimension of the foot. The top surface has an internal peripheral edge defining the opening and a recess extends axially from the opening. The recess is suitably sized to receive the baseplate of the scaffolding member, so that the baseplate can be disposed in the recess of the foot and the weight of the vertical scaffolding member can be distributed over the transverse dimension of the foot of the mud sill. Preferably, a drain hole extends from a lower surface of the recess to the bottom surface of the foot.

According to another aspect of the invention, an improved screw jack is taught with a generally horizontal baseplate secured to a bottom end of an externally threaded screw and an internally threaded wing nut, for use with a base of a vertical scaffolding member that can rest on the wing nut, the screwjack comprising a mud sill, having a transverse dimension measured in all directions that is substantially greater than each dimension in a parallel direction of the generally horizontal baseplate, with a top surface that has an opening, a bottom surface, and an axial dimension, measured between the top surface and the bottom surface, that is perpendicular to the transverse dimension of the mud sill. The top surface has an internal peripheral edge defining the opening and a recess extends axially from the opening. The recess is suitably sized to receive the baseplate of the scaffolding member, so that a top end of the moveable screw can be inserted into the base of a vertical scaffolding member and the generally horizontal baseplate can be disposed in the recess of the mud sill and the weight of the vertical scaffolding member can be distributed over the transverse dimension of the mud sill.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

In one form, the invention is directed to a combination including: a scaffold assembly consisting of a vertical member; a baseplate on the vertical member and having a downwardly facing surface; and a foot having a top surface and a bottom surface spaced in an axial direction. The foot has an opening in the top surface and a recess extending axially from the opening toward the bottom surface. The recess accepts the baseplate with the baseplate in an operative position. The downwardly facing surface bears on the foot so as to cause a downward force produced by the vertical member to be applied to the foot and distributed by the foot through the bottom surface to an underlying support surface for the scaffold assembly. The bottom surface on the foot has a peripheral edge that bounds an area that is greater than an area bounded by a peripheral edge of the baseplate.

In one form, the top surface fully surrounds the opening and the foot opening and recess are configured so that: a) with the baseplate and foot in a first relative angular orientation with respect to a vertical axis, the baseplate can be directed through the opening into the recess; and b) with the baseplate within the recess and the baseplate and foot changed thereafter from the first relative angular orientation around the vertical axis to a second relative angular orientation, a first downwardly facing surface on the foot confronts a first upwardly facing surface on the baseplate to prevent the baseplate from being translated vertically upwardly to be moved through the recess and opening to be separated from the foot.

In one form, the first downwardly and upwardly facing surfaces are each substantially flat, parallel to each other, and oriented to be substantially orthogonal to the vertical axis.

In one form, the recess is bounded by an upwardly facing surface and a drain hole extends from the upwardly facing surface bounding the recess to the bottom surface on the foot.

In one form, the recess has a first part bounded by a first wall portion extending downwardly a first axial distance from the top surface to a first height. The first part of the recess has a shape parallel to a horizontal reference plane that is nominally the same as a shape of the baseplate parallel to the horizontal reference plane.

In one form, the recess has a second part bounded by a second wall portion that extends downwardly from the first height that has a shape that allows the baseplate and foot to be relatively turned around the vertical axis with the baseplate in the second recess part.

In one form, with the baseplate within the first recess part the first wall portion and baseplate interact to limit relative turning of the baseplate and foot around the vertical axis.

In one form, the second wall portion has a substantially circular shape.

In one form, the second wall portion has a shape and dimension that allow the baseplate and foot to be relatively turned through 360° around the vertical axis with the baseplate in the second recess part.

In one form, the baseplate has a vertical thickness and the second wall portion has a vertical dimension that is greater than the vertical thickness of the baseplate.

In one form, the recess has: a) a first part bounded by a first wall portion extending downwardly a first axial distance to a first height; b) a second part extending downwardly from the first height to a second height; and c) a third part extending downwardly from the second height and bounded by a third wall portion. With the baseplate in the first recess part the baseplate and first wall portion interact to limit relative turning of the baseplate and foot around the vertical axis. The baseplate can be directed downwardly through the first recess part into the second recess part with the baseplate and foot in the first angular orientation. With the baseplate in the second recess part the baseplate and foot can be relatively turned around the vertical axis to the second angular orientation. With the foot and baseplate in the second angular orientation, the baseplate can be moved vertically from the second recess part into the third recess part. With the baseplate in the third recess part the baseplate and third annular wall portion interact to limit relative turning of the baseplate and foot around the vertical axis.

In one form, the scaffold assembly has a second vertical member spaced horizontally from the first noted vertical member and with a second baseplate and the foot cooperates with the second baseplate in the same manner as the first noted baseplate cooperates with the first noted baseplate.

In one form, the vertical member has a tubular member, an externally threaded screw on the baseplate that telescopingly engages the tubular member and an internally threaded wing nut threadably engaged with the externally threaded screw. The tubular member has a bottom edge that rests upon the wing nut.

BRIEF DESCRIPTION OF THE DRAWING

Embodiments of the invention are illustrated by way of example, and not by way of limitation, in the figures of the accompanying drawings and in which like reference numerals refer to similar elements and in which.

DETAILED DESCRIPTION OF THE INVENTION

In the following description, specific details are set forth in order to provide a thorough understanding of the invention. However, it will be apparent that the invention may be practiced without these specific details.

Figure 1A:
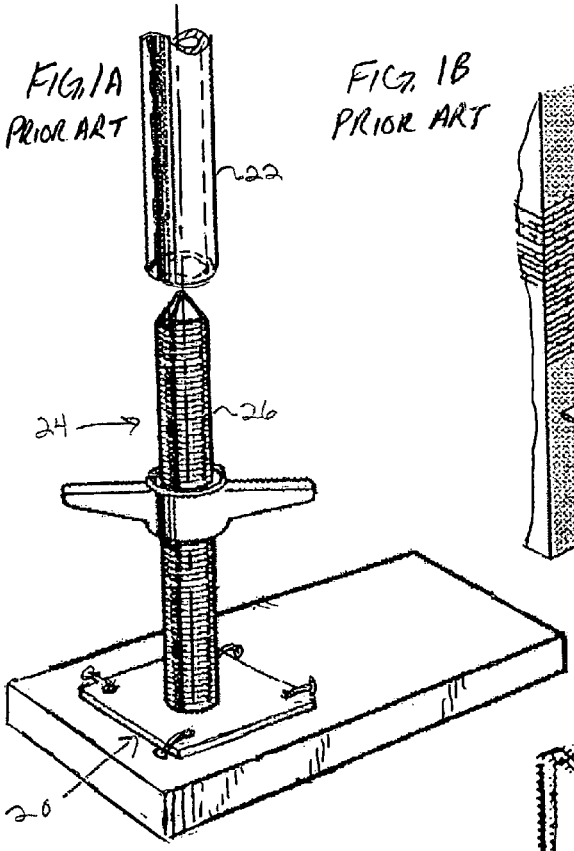
FIG. 1A PRIOR ART
FIG. 1A is an exploded perspective view of a known screw jack with the baseplate that is nailed to a board used as a mud sill.

The present invention teaches an improved mud sill 1 having a foot 2 that is easy to install and remove with a minimal amount of labor required. The improved mud sill attaches securely as to the baseplate 20 of a screw jack 24 on a vertical member on a scaffolding assembly without the use of extraneous fasteners, such as nails or screws, as shown in the prior art uses in FIGS. 1A and 1B to increase the supporting area bounded by the peripheral edge of the foot compared to the area bounded by the peripheral area of the baseplate. The improved mud sill 1 of FIG. 2 is generally disk shaped with top surface 1*a* and a bottom surface 1*b* and an axis extending between the top surface and the bottom surface. A multi-layered/-part recess 3 is provided in the improved mud sill to receive a baseplate 20 axially with the foot 2 and baseplate 20 in a first relative angular orientation with respect to a vertical axis and then the improved mud sill is rotated around the vertical axis relative to the baseplate 20 to place the foot 2 and baseplate 20 in a second relative angular orientation to secure the baseplate 20 in place. Once installed the improved mud sill of this important invention is restricted three dimensionally to the baseplate and yet it can easily be removed by a counter-rotation from the installation process. No nails or tools are required.

Without departing from the generality of the invention disclosed herein and without limiting the scope of the invention, the discussion that follows, will refer to the invention as depicted in the drawing.

Figure 1B:
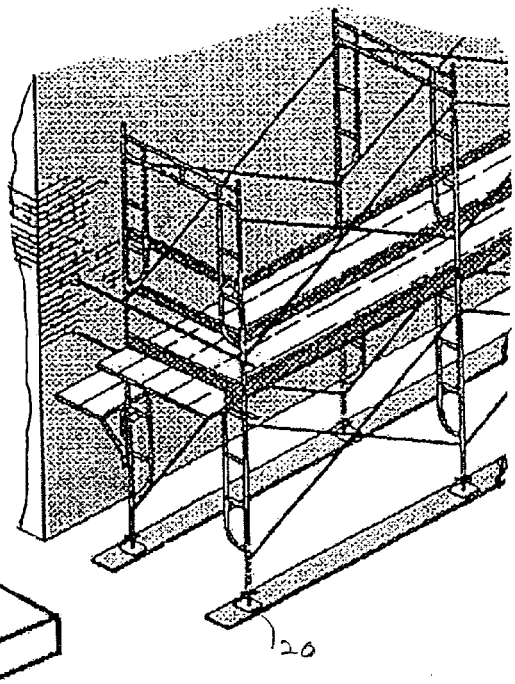
FIG. 1B PRIOR ART
FIG. 1B is a perspective view of a known scaffolding assembly with the mud sill consisting of an elongate board to which the baseplate is nailed.
Figure 2:
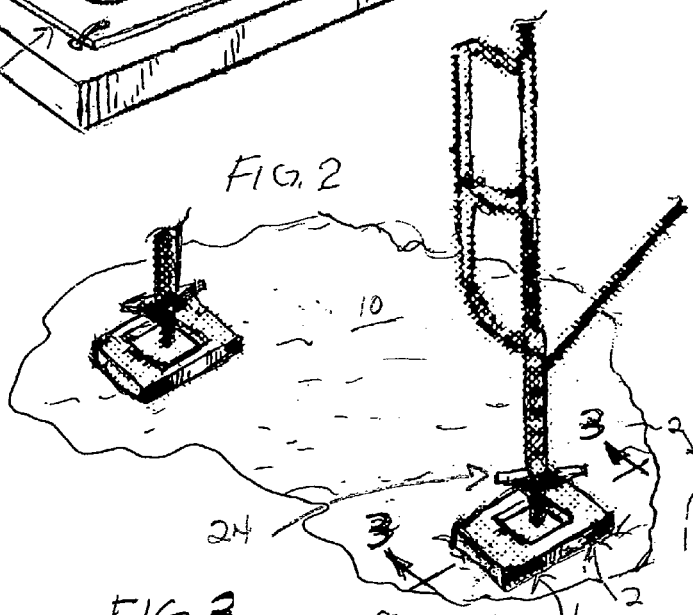
FIG. 2 is a perspective view of the improved mud sill disposed on the horizontal baseplate of a base of a vertical scaffolding member.
Figure 3A:
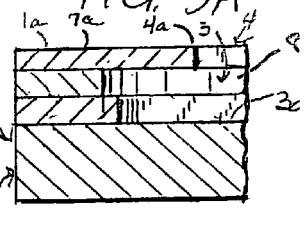
FIG. 3A is a cross sectional view of another embodiment of the foot showing each layer of the recess comprising a layer of the foot with a further additional layer on the bottom of the foot.
Figure 3:
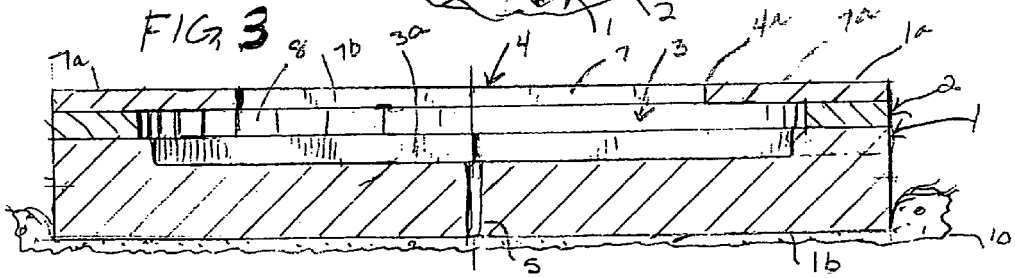
FIG. 3 is a cross sectional view taken along the lines 3-3 of FIG. 2 showing one embodiment of the mud sill with a recess extending axially from the opening of the top surface of the foot and a drain hole extending from the lower surface of the recess to the bottom surface of the foot with the recess comprising three axial double layers.
Figure 4:
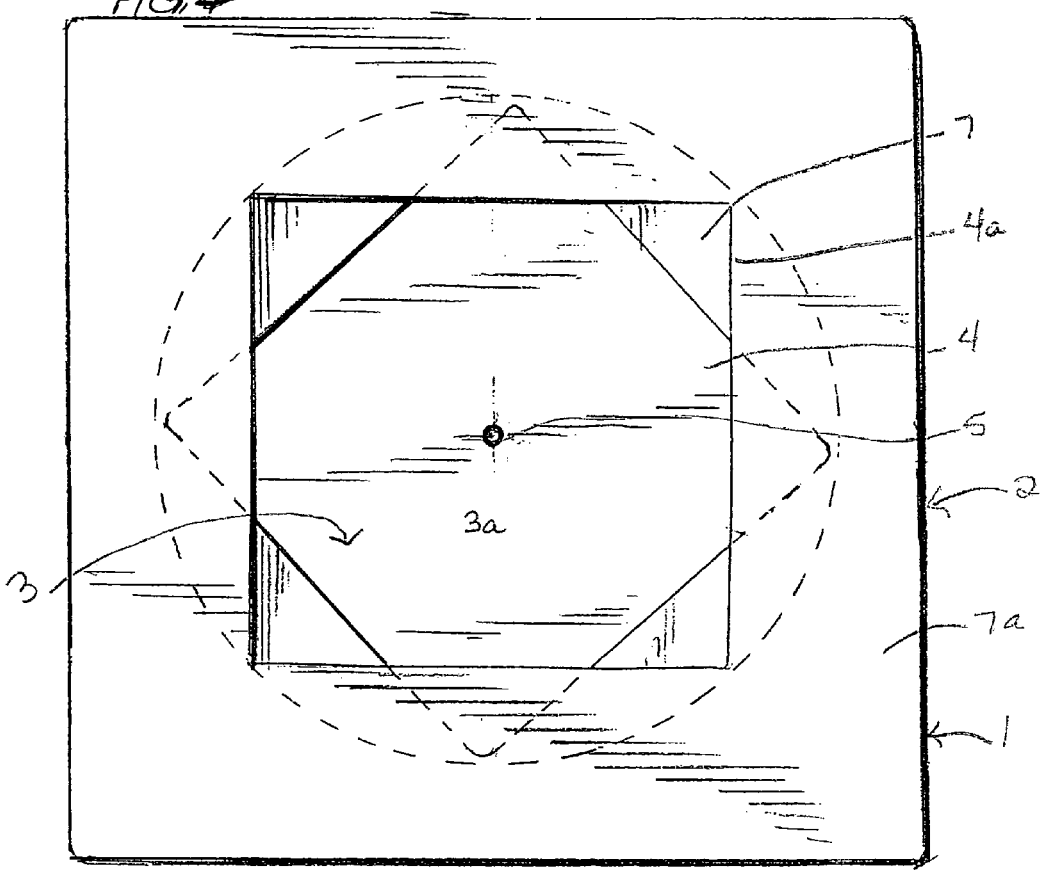
FIG. 4 is a top plan view of the mud sill showing a first axial layer with sides that are parallel to the sides of the foot; a second axial layer, shown in phantom, with a circular shape; a third axial layer which bears the same shape as the first axial layer but is rotated such that a baseplate disposed therein will not be free to axially move out of the mud sill.

According to one embodiment of the invention, an improved mud sill 1, for use with a generally horizontal baseplate 20 of a base of a vertical scaffolding member 22, that is in turn part of a scaffold assembly as shown in FIG. 1B, is taught comprising a foot 2 with a transverse dimension measured in all directions that is substantially greater than each dimension in a parallel direction of the generally horizontal baseplate 20, and with a top surface that has an opening, a bottom surface, and an axial dimension, measured between the top surface 1*a* and the bottom surface 1*b*, that is perpendicular to the transverse dimension of the foot 2. The top surface 1*a* has an internal peripheral edge 4*a* defining the opening 4 and a recess 3 extends axially from the opening 4. The recess 3 is suitably sized to receive the baseplate 20 of the scaffolding member 22, so that the baseplate 20 can be disposed in the recess 3 of the foot 2 and the weight of the vertical scaffolding member 22 is directed against the mud sill 1 that distributes the weight forces over the area of the mud sill bearing on the subjacent surface 10. Preferably, a drain hole 5 extends from a lower surface 3*a* of the recess 3 to the bottom surface 1*b* of the foot 2.

A preferred opening 4 has a transverse dimension measured in all directions that is greater than each dimension in a parallel direction of the generally horizontal baseplate 20. Moreover, the recess 3 may comprise a first axial layer 7 defined by an upper surface having the internal peripheral edge 4*a* of the opening 4, a first lower surface 7*b* having a peripheral edge, and an inner wall portion 6 bounding a first recess part and having an upper edge connected to the internal peripheral edge 4*a* of the opening 4 and a lower edge connected to the peripheral edge of the first lower surface 7*b*. The first recess part in the first axial layer 7 may have a transverse shape corresponding nominally to the transverse shape of the baseplate 20 so that the foot 2 and baseplate 20 interact to limit relative turning between the foot 2 and baseplate 20. The peripheral transverse shape of the first axial layer 7 may correspond to the peripheral transverse shape of the baseplate 20.

Additionally, the recess 3 may have a plurality of axial layers of varying transverse dimensions, so that the baseplate 20 can be inserted past the first recess part bounded by the wall portion 6 on the first axial layer 7 into a second recess part bounded by a second wall portion on a second axial layer 8 at a pre-determined axial depth and rotated in the second axial layer to secure the baseplate axially in said recess 3. Preferably, the second axial layer 8 has the shape of a circular disk.

In the preferred embodiment shown in FIGS. 3-7 and 10-11, the recess 3 has a second axial layer 8 comprising at least one radial recess part 3 disposed axially at a predetermined distance from the top surface 1*a* of the foot 2. The at least one radial recess 3 has an axial dimension greater than the thickness of the baseplate 20 between oppositely facing, and parallel, flat surfaces and has a radial dimension that is greater than a maximum transverse dimension of the baseplate, so that when the baseplate is inserted into the recess 3 and aligned with the second recess part in the axial layer 8, the baseplate 20 can be rotated freely through 360° in the recess 3 to secure the baseplate axially in said recess 3 by placing the upwardly facing surface of the baseplate 20 in confronting relationship with a parallel flat surface on the foot 2.

Figure 10:
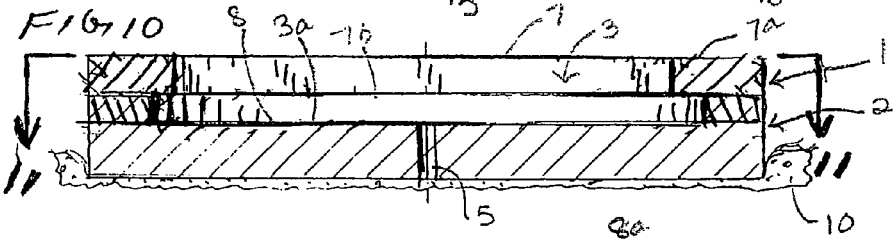
FIG. 10 is a cross sectional view of another preferred embodiment of the mud sill showing a first axial layer in which the adapted and constructed to receive the baseplate of the screw jack and a second axial layer that is generally circular.
Figure 11:
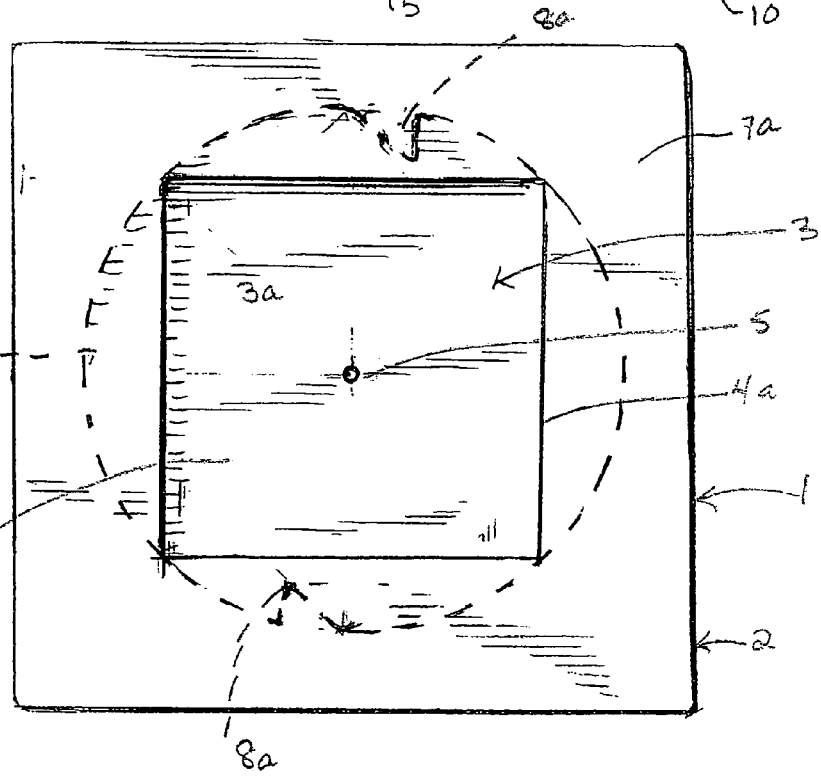
FIG. 11 is a top plan view of the mud sill showing a first axial layer and a second axial layer, shown in phantom, with a circular shape having at least one protuberance in the path of a rotating baseplate.

Moreover, the second axial layer 8 of the recess 3 may have at least one protuberance 8*a* in the path of a rotating baseplate 20 to restrict the rotation of the baseplate within the second axial layer 8 of the recess 3 to limit movement of the baseplate rotationally in said recess 3, as shown in FIGS. 10 and 11.

In one embodiment, as shown in FIGS. 3-7 and 10-11, the recess 3 may have a third axial layer 9 comprising at least a third radial recess part 3 disposed axially between the second axial layer and the lower surface of the recess 3. The third axial layer 9 preferably has a transverse shape corresponding to the transverse shape of the baseplate 20 and the third axial layer is axially aligned with the first axial layer 7 and the second axial layer 8, and said third axial layer 9 is rotatingly nonaligned with the first axial layer to limit axial and rotational movement of the baseplate in said recess 3. The peripheral wall portion on the layer 9 bounding the third recess part and the baseplate interact to limit relative turning of the foot 2 and baseplate 20 around a vertical axis.

Figures 6, 7, 8:
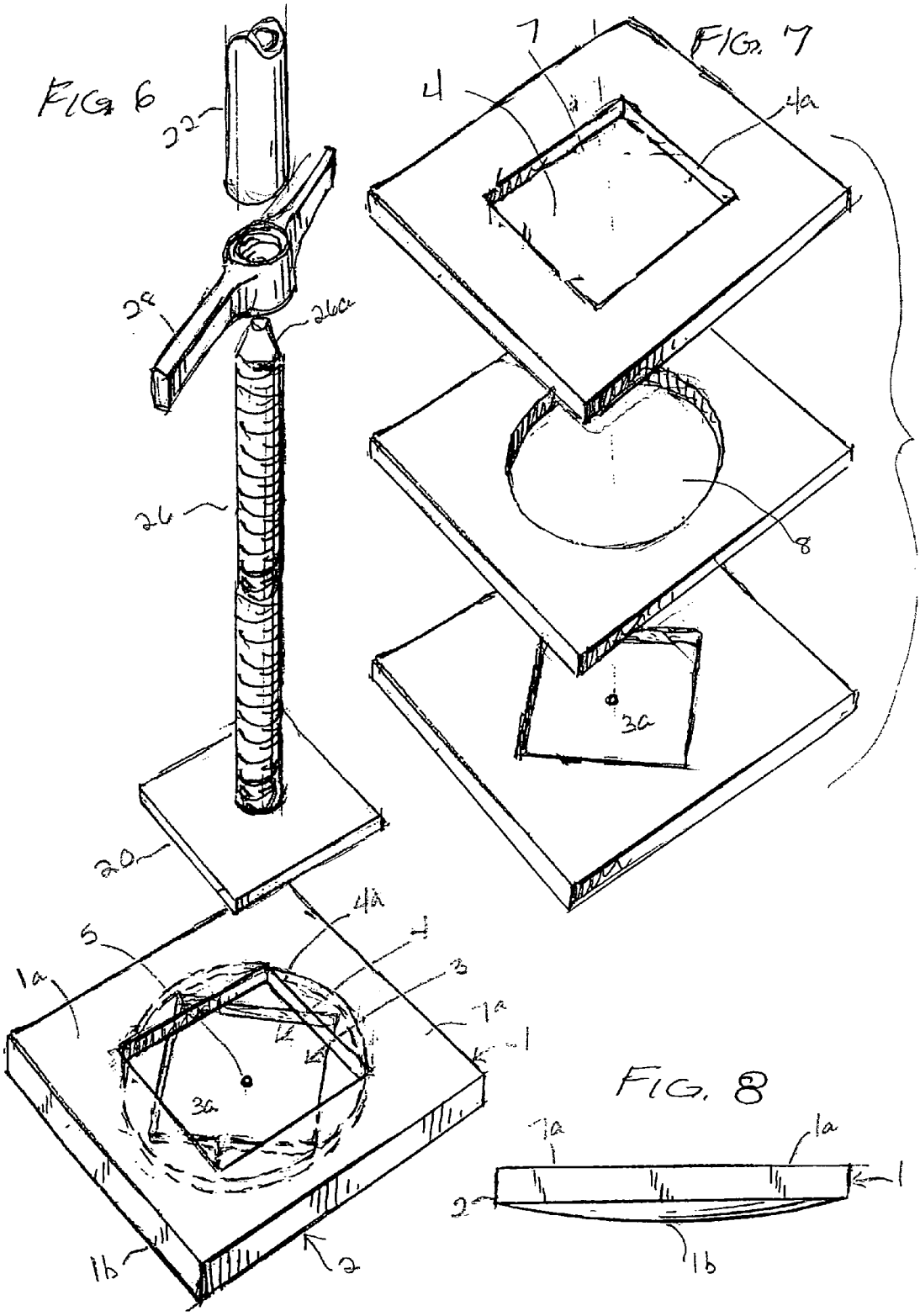
FIG. 6 is an exploded perspective view of an improved screw jack of the present invention with a generally horizontal baseplate and comprising a mud sill.
FIG. 7 is an exploded view of the axial layers of the mud sill shown in FIG. 3.
FIG. 8 is a side elevation view of a preferred embodiment of the mud sill showing a convex bottom surface.

Referring to FIG. 8, the bottom surface 1*a* of the foot 2 may be convex, allowing the weight of the vertical scaffolding member 22 to be distributed perpendicularly to the tangent of the convex bottom surface of the foot 2 so that the scaffolding member 22 can be laterally restrained at its base. This embodiment is particularly well suited to soft soil conditions.

Another preferred embodiment of the improved mud sill 1, for use with a generally horizontal baseplate 20 of a base of a vertical scaffolding member 22, comprises a foot 2, having a transverse dimension measured in all directions that is substantially greater than each dimension in a parallel direction of the generally horizontal baseplate 20, with a top surface that has an opening 4, a bottom surface 1*b*, and an axial dimension, measured between the top surface and the bottom surface, that is perpendicular to the transverse dimension of the foot 2. The top surface has an internal peripheral edge defining the opening 4. The opening has a transverse dimension measured in all directions that is greater than each dimension in a parallel direction of the generally horizontal baseplate 20 and a recess 3 extends axially from the opening with a drain hole 5 extends from a lower surface of the recess to the bottom surface of the foot 2. The recess is suitably sized to receive the baseplate 20 of the scaffolding member 22, so that the baseplate can be disposed in the recess 3 of the foot 2 and the weight of the vertical scaffolding member can be distributed over the transverse dimension of the foot of the mud sill 1.

Figure 9:
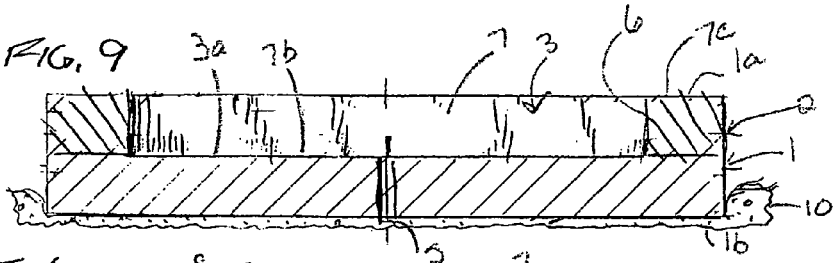
FIG. 9 is a cross sectional view of one embodiment of the invention showing a recess comprising an axial layer in which a baseplate of a screw jack may be disposed.

Referring to FIG. 9, the recess 3 may comprise a first axial layer 7 defined by an upper surface 7*a* having the internal peripheral edge of the opening 4, a first lower surface 7*b* having a peripheral edge, and an inner wall 6 having an upper edge connected to the internal peripheral edge of the opening and a lower edge connected to the peripheral edge of the lower surface.

Figure 12:
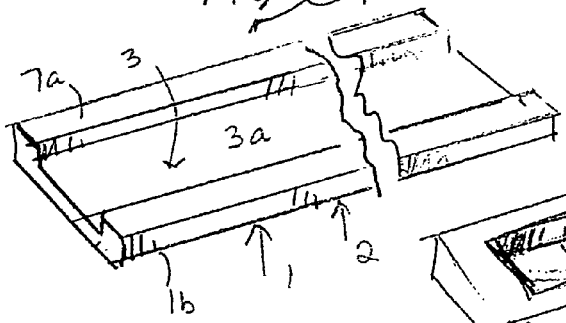
FIG. 12 is a fragmentary perspective view of an elongated foot of a mud sill where the opening comprises an elongated trough extending longitudinally along at least a substantial portion of the elongated foot.

In one embodiment, as shown in FIG. 12, the improved mud sill 1, for use with a generally horizontal baseplate 20 of a base of a vertical scaffolding member 22 of a scaffolding system with a predetermined distance between the vertical scaffolding members, comprises an elongated foot 2, having a longitudinal dimension that is greater than the predetermined distance between the vertical scaffolding members and a transverse dimension measured in all directions that is substantially greater than each dimension in a parallel direction of the generally horizontal baseplate 20, with a top surface that has at least one opening 4, a bottom surface, and an axial dimension, measured between the top surface and the bottom surface, that is perpendicular to the longitudinal dimension of the foot 2. The top surface has an internal edge defining each of the at least one opening 4, each opening having a transverse dimension measured in all directions that is greater than each dimension in a parallel direction of the generally horizontal baseplate 20 with a recess 3 extending axially from each opening 4. Each said recess 3 is suitably sized to receive at least one baseplate of the scaffolding member 22, in this way, at least one baseplate can be disposed in the recess 3 of each opening of the foot 2 and the weight of each vertical scaffolding member associated with each at least one baseplate can be distributed over the transverse dimension of the foot 2 of the mud sill 1.

Figure 13:
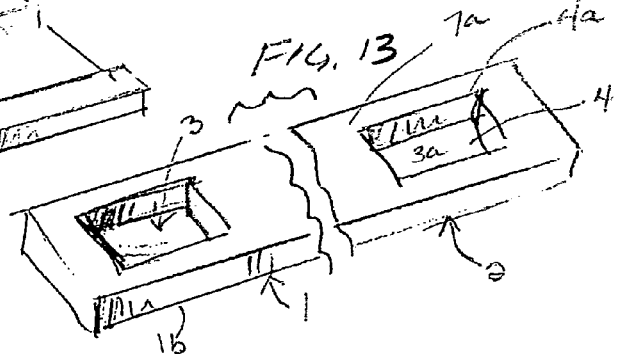
FIG. 13 is a fragmentary perspective of another preferred embodiment of the elongated foot of the improved mud sill in which the elongated foot has a plurality of openings, each of which can accommodate one baseplate of the base of the scaffolding assembly.

In another embodiment, as shown in FIG. 13, the elongated foot 2 has a plurality of openings, each opening 4 being spaced from one another at the predetermined distance. In yet another embodiment the opening 4 comprises an elongated trough extending longitudinally along at least a substantial portion of the elongated foot 2. A drain hole 5 may extend from a lower surface of the recess 3 to the bottom surface of the foot 2.

According to one embodiment of this important invention, an improved screw jack 24, as shown in FIG. 6, is taught with a generally horizontal baseplate 20 secured to a bottom end of an externally threaded screw 26 and an internally threaded wing nut 28, for use with a base of a vertical scaffolding member 22 that can rest on the wing nut 28, the screw jack comprising a mud sill 1, having a transverse dimension measured in all directions that is substantially greater than each dimension in a parallel direction of the generally horizontal baseplate 20, with a top surface 1*a* that has an opening 4, a bottom surface 1*b*, and an axial dimension, measured between the top surface and the bottom surface, that is perpendicular to the transverse dimension of the mud sill 1. The top surface has an internal peripheral edge 4*a* defining the opening 4 and a recess 3 extends axially from the opening 4. The recess 3 is suitably sized to receive the baseplate of the scaffolding member 22, so that a top end 26*a* of the moveable screw 26 can be inserted into the base of a vertical scaffolding member 22 and the generally horizontal baseplate 20 can be disposed in the recess 3 of the mud sill 1 and the weight of the vertical scaffolding member can be distributed over the transverse dimension of the mud sill 1.

Figure 5A:
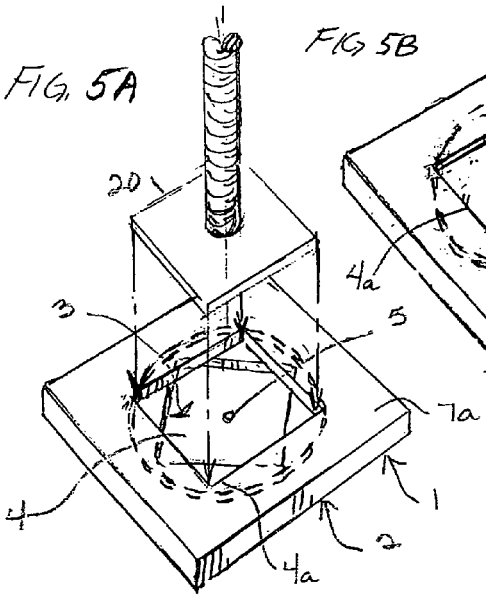
FIG. 5A shows the bottom portion of a screw jack including the horizontal baseplate exploded away from a preferred embodiment of the mud sill of the current invention.
Figure 5B:
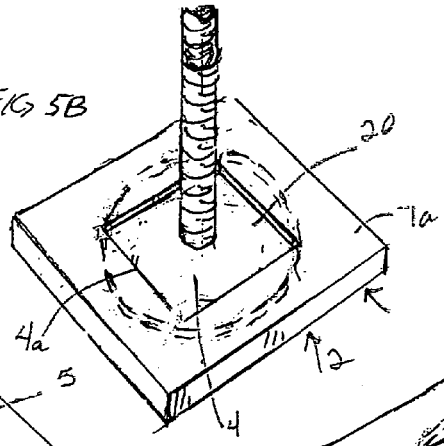
FIG. 5B shows the elements of FIG. 5A but with the baseplate inserted into the recess.
Figure 5C:
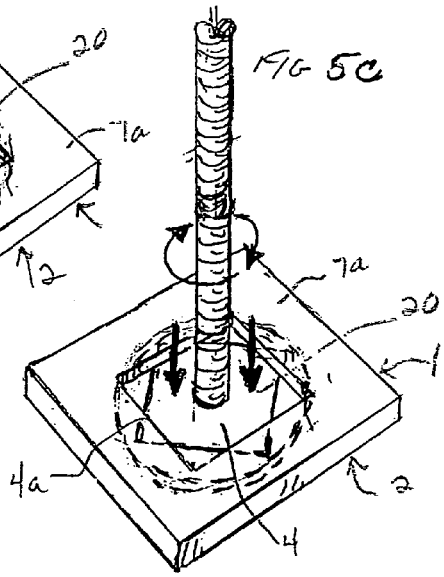
FIG. 5C shows the baseplate further inserted into the second axial layer of the recess where it is free to be rotated, as show with the rotational arrows about the screw, and when properly rotated to be aligned with the third axial layer and can be moved axially toward the bottom of the recess to be disposed in the third axial layer.

Preferably, a drain hole 5 extends from a lower surface 3*a* of the recess 3 to the bottom surface of the foot 2. As shown in FIGS. 5A-5C, the opening 4 has a transverse dimension measured in all directions that is greater than each dimension in a parallel direction of the generally horizontal baseplate 20.

According to one aspect of the invention, the recess 3 comprises a first axial layer 7 defined by an upper surface 7*a* having the internal peripheral edge 4*a* of the opening 4, a first lower surface having a peripheral edge, and an inner wall having an upper edge connected to the internal peripheral edge of the opening 4 and a lower edge connected to the peripheral edge of the lower surface.

The mud sill 1 or foot 2 can be made of suitable materials, including wood, plastic or other hard material. It can be constructed in layers, as shown in FIG. 7, and fastened together with a fastener including a water insoluble adhesive. For mud sills having a uniform recess 3, a simple boring process can be employed to make the recess 3.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, including variations in size, materials, shape, form, function and manner of operation, assembly and use, and all equivalent relationships to those illustrated in the drawings and described in the specification, that would be deemed readily apparent and obvious to one skilled in the art, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In combination:

a scaffold assembly comprising a vertical member;

a baseplate on the vertical member and having a downwardly facing surface; and a foot having a top surface and a bottom surface spaced in an axial direction, the foot having an opening in the top surface and a recess extending axially from the foot opening toward the bottom surface, the recess accepting the baseplate with the baseplate in an operative position;

the downwardly facing surface bearing on the foot so as to cause a downward force produced by the vertical member to be applied to the foot and distributed by the foot through the bottom surface to an underlying support surface for the scaffold assembly, the bottom surface on the foot having a peripheral edge that bounds an area that is greater than an area bounded by a peripheral edge of the baseplate, wherein the top surface fully surrounds the foot opening and the foot opening and recess are configured so that: a) with the baseplate and foot in a first relative angular orientation with respect to a vertical axis, the baseplate can be directed through the foot opening into the recess; and b) with the baseplate within the recess and the baseplate and foot changed thereafter from the first relative angular orientation around the vertical axis to a second relative angular orientation a first downwardly facing surface on the foot confronts a first upwardly facing surface on the baseplate to prevent the baseplate from being translated vertically upwardly to be moved through the recess and foot opening to be separated from the foot, wherein the first downwardly and first upwardly facing surfaces are each substantially flat, parallel to each other, and oriented to be substantially orthogonal to the vertical axis.

2. The combination according to claim 1 wherein the recess is bounded by an upwardly facing surface and a drain hole extends from the upwardly facing surface bounding the recess to the bottom surface on the foot.

3. The combination according to claim 1 wherein the recess has a first part bounded by a first wall portion extending downwardly from the top surface to a first height, the first part of the recess having a shape parallel to a horizontal reference plane that is nominally the same as a shape of the baseplate parallel to the horizontal reference plane.

4. The combination according to claim 3 wherein the recess has a second part bounded by a second wall portion that extends downwardly from the first height that has a shape that allows the baseplate and foot to be relatively turned around the vertical axis with the baseplate in the second recess part.

5. The combination according to claim 4 wherein the second wall portion has a substantially circular shape.

6. The combination according to claim 4 wherein the second wall portion has a shape and dimension that allow the baseplate and foot to be relatively turned through 360° around the vertical axis with the baseplate in the second recess part.

7. The combination according to claim 6 wherein the baseplate has a vertical thickness and the second wall portion has a vertical dimension that is greater than the vertical thickness of the baseplate.

8. The combination according to claim 1 wherein the recess has a first part bounded by a wall portion extending downwardly from the top surface and with the baseplate within the first recess part the first wall portion and baseplate interact to limit relative turning of the baseplate and foot around the vertical axis.

9. The combination according to claim 1 wherein the recess has: a) a first part bounded by a first wall portion extending downwardly a first axial distance to a first height; b) a second part extending downwardly from the first height to a second height; and c) a third part extending downwardly from the second height and bounded by a third wall portion, wherein: i) with the baseplate in the first recess part the baseplate and first wall portion interact to limit relative turning of the baseplate and foot around the vertical axis; ii) the baseplate can be directed downwardly through the first recess part into the second recess part with the baseplate and foot in the first angular orientation; iii) with the baseplate in the second recess part the baseplate and foot can be relatively turned around the vertical axis to the second angular orientation; iv) with the foot and baseplate in the second angular orientation, the baseplate can be moved vertically from the second recess part into the third recess part; and v) with the baseplate in the third recess part the baseplate and third annular wall portion interact to limit relative turning of the baseplate and foot around the vertical axis.

10. The combination according to claim 1 wherein the scaffold assembly comprises a second vertical member spaced horizontally from the first claimed vertical member and with a second baseplate and the foot cooperates with the second baseplate in the same manner as the first claimed baseplate cooperates with the first claimed baseplate.

11. The combination according to claim 1 wherein the vertical member comprises a tubular member, an externally threaded screw on the baseplate that telescopingly engages the tubular member and an internally threaded wing nut threadably engaged with the externally threaded screw and the tubular member has a bottom edge that rests upon the wing nut.

* * * * *